United States Patent [19]

Anderson

[11] Patent Number: 4,729,389

[45] Date of Patent: Mar. 8, 1988

[54] FILTER FOR TOBACCO SMOKE

[76] Inventor: Joseph H. Anderson, 1817 South "I" St., Bedford, Ind. 47421

[21] Appl. No.: 868,260

[22] Filed: Jan. 10, 1978

Related U.S. Application Data

[63] Continuation of Ser. No. 747,570, Dec. 6, 1976, abandoned, which is a continuation of Ser. No. 642,424, Dec. 19, 1975, abandoned, which is a continuation of Ser. No. 507,442, Sep. 19, 1974, abandoned.

[51] Int. Cl.[4] ..... A24D 3/08; A24D 3/16

[52] U.S. Cl. ..... 131/331; 131/342; 131/333; 131/344

[58] Field of Search ..... 131/17 R, 2, 265, 266, 131/267, 10 R, 10 A, 10.3, 10.5, 10.7, 10.9, 261 R, 264, 200, 202, 203, 331, 333, 334, 342–345

[56] References Cited

U.S. PATENT DOCUMENTS

| | | | |
|---|---|---|---|
| 3,428,054 | 2/1969 | Scarabello et al. | 131/265 |
| 3,461,880 | 8/1969 | Stubblefield | 131/265 X |
| 4,059,119 | 11/1977 | Grossman | 131/9 |
| 4,149,549 | 4/1979 | Grossman | 131/261 R |

FOREIGN PATENT DOCUMENTS

| | | | |
|---|---|---|---|
| 0885797 | 11/1971 | Canada | 131/267 |
| 0752358 | 7/1956 | United Kingdom | 131/266 |

*Primary Examiner*—V. Millin

*Attorney, Agent, or Firm*—Richard G. Heywood

[57] ABSTRACT

A filter comprising kaolin fibers useful for removing deleterious materials from tobacco smoke and reducing the temperature thereof.

12 Claims, No Drawings

FILTER FOR TOBACCO SMOKE

This is a continuation of application Ser. No. 747,570, filed 12/6/76, now abandoned, which is a continuation of application Ser. No. 642,424, filed 12/19/75, now abandoned, which is a continuation of application Ser. No. 507,442, filed 9/19/74, now abandoned.

BACKGROUND OF THE INVENTION

It is well known that tobacco smoke contains various alkaloids such as nicotine and volatile materials such as tar, which are believed to be physiologically harmful to a smoker. It is also known that the generation of these harmful materials is promoted by high temperature and that the heat itself is detrimental to the smoker's health. Various filters have been proposed to remove nicotine and tar, but none has been entirely satisfactory since they have either been substantially ineffective for those purposes or have produced a filtered smoke of inferior draw or taste. Commercially available prior art filters have been made from glass fibers, cellulosic fibers, activated charcoal or the like. In the case of ordinary sized cigarettes, these filters are usually 20 mm. in length and in king sized cigarettes the filters are generally 25 to 27 mm. long.

Various forms of kaolin clay have also been proposed for use in filters, but these forms differ from that utilized in the present invention. For example, U.S. Pat. No. 3,650,279 discloses a cigarette filter composed of a powdered aluminum silicate mineral which is prepared by rendering the mineral electropositive and then cationizing it by absorbing macromolecular cations (such as methylene blue and $FeSO_4$) thereon. A further example of prior art uses of kaolin clays is U.S. Pat. No. 3,428,054 which relates to a cigarette filter composed of mineral particles, such as slag, and absorptive powdered clay, such as kaolinite, bound together by a non-toxic binder. A still further example of prior art uses of kaolin clay is U.S. Pat. No. 3,251,365 wherein a cigarette filter is disclosed composed of powdered clay, such as kaolin, into which from 1 to 13 percent by weight of iron or zinc oxide is incorporated. And finally, U.S. Pat. No. 2,967,118 shows a specially prepared kaolin clay powder which has been acid activated for use in filters. Powdered clays proposed for use as tobacco smoke filters as in the above-mentioned patents are believed to be only partially effective since they have a marked effect on draw resistance and taste of the smoke and for other reasons.

OBJECTS OF THE INVENTION

It is an object of this invention to provide a filter for tobacco smoke which effectively reduces the amount of various alkaloids and volatile materials, such as nicotine and tar, in the smoke and reduces the temperature of the smoke while having an insubstantial effect on the draw and flavor.

It is another object to provide for filtration of tobacco smoke in a manner which will cause a greater amount of alkaloids and volatile substances to be removed from the smoke than in prior filters.

Another object is to provide a novel tobacco smoke filter which will not melt, burn or otherwise be substantially affected at tobacco burning temperatures.

Still another object of the invention is to provide a tobacco smoke filtration material having an exceptional capacity to entrap alkaloids and volatiles and to reduce smoke temperatures which may be employed alone or in combination with other smoke filtering units.

Another object is to provide a multicomponent filter such as a dual-filter having exceptional filtration properties for a tobacco smoking article in which at least one unit of the filter is comprised of fibrous refractory kaolin clay material.

Another object is to provide a highly effective filter which may be smaller in size than standard-sized prior filters.

Other objects and advantages of this invention will be readily apparent to those skilled in the art in view of the following description.

DETAILED DESCRIPTION OF THE INVENTION

The present invention pertains to an improved filter for tobacco smoking articles, such as cigarettes, cigars and pipes. The filter unit embodying the present invention utilizes substantially homogeneous fibers formed by conventional techniques from kaolin clays. That is, kaolin hydrous clays are fused or fire dried and blown or spun into anhydrous fibers having various lengths, weights, densities or the like. In general, the kaolin clay fiber material preferably is comprised of aluminum silicate having on analysis an alumina and silica content in the range of about 95 to about 99.5 percent by weight, these kaolin fibers also being referred to in the trade as "alumina-silica fibers" and comprising one form of synthetic, inorganic, water-insoluble, anhydrous fibrous material. However, depending on the place mined, the kaolin clay may contain from about 0.5 to about 5.0 percent by weight of other minerals. Often these other minerals are other aluminum silicates containing differing amounts of silica. They may also be other than aluminum silicate minerals for example such as those which on analysis contain materials such as iron oxide, titania, magnesia, calcia, boric anhydride, various alkalies including sodium oxide, or the like.

Suitable, commercially available kaolin fibers which are presently marketed in varius lengths, weights, densities or the like are sold by Babcock and Wilcox under the trademark KAOWOOL, by Carborundum under the trademark FIBERFRAX, by Jonhs-Manville under the trademarks J-M CERAFELT and PURE WHITE CERAFIBER and by others under different marks. By way of example, the composition according to chemical analysis of KAOWOOL fibers sold by Babcock and Wilcox is substantially as follows:

| Constituent | Percent by Weight |
|---|---|
| Alumina as $Al_2O_3$ | 45.1 |
| Silica as $SiO_2$ | 51.9 |
| Iron Oxide as $Fe_2O_3$ | 1.3 |
| Titania as $TiO_2$ | 1.7 |
| Magnesia as MgO | trace |
| Calcia as CaO | 0.1 |
| Alkalies as $Na_2O$ | 0.2 |
| Boric Anhydride as $B_2O_3$ | 0.08 |

The above-described kaolin fibers are refractory and will stand continuous exposure to heats as high as about 2300° F., whereas the peak temperature in a burning cigarette is about 1600° F. This refractory property is advantageous since, for example, a cigarette having a kaolin fiber filter positioned against the burnable tobacco charge may be allowed to burn down to the filter without substantial fire hazard.

The kaolin fibers in the subject filter should have a diameter and length so that they may be packed into filters having a density and size satisfactory to function as effective tobacco smoke filters, but not to adversely affect the pressure gradient of the smoke through the filter. For example, the fibers may have an average diameter between about 1 and about 5 microns, but it is preferred that the fibers have an average diameter of about 2.8 microns. The fibers may be of any desired length, but it is preferred that they be from about 0.5 inch to about 10 inches long and have an average length of about 3 to 4 inches. The fibers may be twisted, woven, compressed or otherwise physically intermeshed or bonded together into blankets, strips, cylinders, ropes, braids or any other desired form of substantially homogeneous kaolin fiber material. However, in so doing, the density of the material should be less than about 8 pounds per cubic foot, and preferably the density should be from about 2.5 pounds per cubic foot to about 4.5 pounds per cubic foot. The fibrous material formed into the above-mentioned blankets, strips, cylinders, ropes, braids or the like is weighed or otherwise readied for use as a filter unit to be enveloped in a conventional filter tube. In this regard, it is preferred that the filter for an ordinary cigarette having an average length of about 85 mm. or a longer, so-called king sized cigarette having an average length of about 100 mm. weigh about 0.01 g. to about 0.2 g. and, more preferred, about 0.02 g. to about 0.1 g. While the above-mentioned weights of kaolin fiber materials are preferred, it will be appreciated that any amount of fiber will be effective at removing alkaloids and volatiles until saturated therewith. In this regard, filters comprised of less than the above weights and packed in a length of 1 mm. have been tested with ordinary sized cigarettes and have been found effective therewith. Filters for other smoking articles such as cigars and pipes may be of similar size to those above-described or adjusted as required by the size, nature, or the like of the tobacco charge.

It is possible to employ the above-mentioned kaolin fibers alone as a sole filtering agent and, in these cases, the kaolin filter will normally occupy less than the space usually associated with a conventional filtering unit. Nonetheless, the fiber is sometimes packed in a standard filter tube; for example in an ordinary sized cigarette the kaolin fibers may be packed in a standard sized tube having a length of about 20 mm. (as above-mentioned) and in a king sized cigarette the fibers may be packed in a standard sized tube having a length of about 25 to 27 mm. (as above-mentioned). If it is desired, the kaolin fiber filter may be fitted into a filter tube much smaller than that above-described as normally associated with ordinary and king sized cigarettes; however, it may be preferred in some cases to use the ordinary filter tubes therewith so that the conventional appearance and proportion of the cigarette may be maintained.

While the kaolin fibers may be used alone, they are in general utilized with other conventional non-toxic filtering materials. Thus, for example, the kaolin fibers of this invention are employed in combination with cellulosic materials such as cellulose acetate as well as with inorganic materials such as activated carbon, clays, glass fibers or the like, with polymeric materials such as polyurethanes or other suitable thermoplastic materials or with natural materials such as wool. In the preferred embodiment, a kaolin fiber filter is placed adjacent to the burnable tobacco charge and a conventional filter is placed between the kaolin fiber filter and the mouth of the smoker. Alternatively, the kaolin fiber filter may be placed between a conventional filter and the mouth of the smoker; however, the refractory advantages of the present kaolin fiber filter are not enjoyed in this construction. In other embodiments, a plurality of kaolin fiber filters may be sandwiched between conventional filters. In still other embodiments, the kaolin fiber material may be intermixed with conventional filter material. In yet other embodiments, the kaolin fiber material is rolled as a core and a conventional filter material is placed circumferentially thereabout. And finally, in other embodiments, the kaolin fiber material is intermixed with tobacco to thereby form a filter. While all of the above-described embodiments achieve the objects and enjoy some or all of the advantages of the present invention, it is preferred that the kaolin fibers be used in a multicomponent filter wherein the kaolin fiber material is placed adjacent to the burnable tobacco charge so that the cigarette will extinguish itself when the cigarette is burned down thereto. It is also preferred that a conventional filter such as one prepared fron cellulosic material be placed between the kaolin fiber material and the mouth of the smoker inasmuch as the kaolin fiber filter tends to fragment or fall apart and is therefore unpleasant to the smoker. This disadvantage, however, may be overcome by the addition of a physiologically innocuous binder to the kaolin fiber. A commercially available kaolin fiber material having about 2 percent by weight of an unobjectionable binder therein is sold by Babcock and Wilcox under the trademark WET FELT and by others under different trademarks. The chemical analysis of WET FELT is substantially as follows:

| Constituent | Percent by Weight |
|---|---|
| Alumina as $Al_2O_3$ | 37.6 |
| Silica as $SiO_2$ | 59.8 |
| Alkalies as $Na_2O$ | 0.5 |
| Boric Anhydride as $B_2O_3$ | 0.1 |

Although it may partially defeat some of the advantages, it is also contemplated as within the scope of the invention to incorporate various flavorants into the kaolin fiber filter or conventional filter as desired. For example, menthol may be incorporated with the conventional filter unit in a multicomponent filter for use in combination with the kaolin fiber filter of the present invention as above-described.

EXAMPLE 1

A SALEM premium length, menthol cigarette having an overall length of about 100 mm. and a filter length of about 27 mm. was smoked by an aspirator device designed to provide a continuous draw on the burning cigarette. The average temperature of the smoke passing through the filter was 78.56° F.

The filter from another SALEM cigarette was removed from the filter tube and 0.0505 g. of KAOWOOL fiber having an average diameter of substantially 2.8 microns and a density of 3 pounds per cubic foot were rolled into a cylinder having the diameter of the filter tube and a length of about 6 mm. The filter was inserted into the tube and pressed against the tobacco charge with the original filter. The last 6 mm. of the original filter, which extended beyond the filter tube, was cut off leaving about 21 mm. of the original filter in the tube between the kaolin fiber filter and the aspirator device. The cigarette was smoked as described above. The average temperature of the smoke passing through the filter was 76.32° F., which was over two degrees less than the smoke passing through the conventional filter.

EXAMPLE 2

The filter having a length of about 27 mm. was removed from the filter tube from each of two hundred SALEM premium length, menthol cigarettes having a length of 100 mm. 0.0505±0.0101 g. of KAOWOOL having the same physical and chemical properties as the fiber in Example 1 were rolled into a cylinder which had the diameter of the filter tube and a length about 6 mm. The roll was inserted into the tube and pressed against the tobacco charge with the original filter. The last 6 mm. of the original filter, which extended beyond the filter tube, was cut off leaving about 21 mm. of the original filter in the tube behind the kaolin fiber filter. The cigarettes were tested in a smoking machine having a Cambridge CM113A filter, according to recommended FTC procedures. These procedures included smoking the cigarettes to a length of 30 mm. by 35 cc. puffs of 2 second duration and 1 minute frequency at a temperature of 75° F. and 60 percent relative humidity. The weight of dry particulate matter obtained per cigarette (tar) was 11.6 mg. and the weight of nicotine was 0.89 mg.

A comparative analysis as reported in the Federal Trade Commission report of March 1972 utilizing SALEM cigarettes having the same amount and type of burnable tobacco, which were smoked with a standard filter under the same conditions as aforementioned, produced 19.9 mg. of dry particulate material and 1.46 mg. of nicotine per cigarette.

Many other embodiments have also been tested and all have been found satisfactory. For example, kaolin fiber filters as the sole filtering agent have been tested wherein the filter unit is 6 mm., 12 mm. and 18 mm. in length. In these tests the kaolin was placed adjacent to the burnable tobacco charge of a king sized 100 mm. cigarette in a filter tube having an overall length of 27 mm., thereby forming a recessed filter. Further tests have been made wherein kaolin fiber material is sandwiched between conventional cellulosic units to form a multicomponent filter. For example, filters comprised of two 3 mm. kaolin fiber filters sandwiched between three 7 mm. cellulosic filters have been tested with king sized cigarettes. Tests have also been conducted wherein kaolin fiber is admixed with the last half or with the entire portion of the burnable tobacco charge. In these tests and others commensurate with the scope of the invention, kaolin fiber has been found effective in reducing the alkaloids and volatiles in the tobacco smoke.

It will be readily apparent from the foregoing description and examples that the present invention contributes a substantial improvement to the tobacco smoke filter art by providing a filter whereby the amount of alkaloids such as nicotine and volatile materials such as tar, and the temperature of the smoke is substantially reduced without materially affecting the draw and flavor of the smoke. It will also be readily apparent to those skilled in the art that various changes and modifications may be made therein without departing from the spirit and scope of the invention as it is more precisely defined in the subjoined claims.

What is claimed is:

1. A tobacco smoking article comprising, in combination, a body of divided tobacco to be burned and which upon the burning thereof produces moisture-laden smoke containing alkaloid and volatile materials, and a filter unit for said tobacco smoke comprising synthetic, inorganic, water-insoluble, anhydrous fibers consisting essentially of substantially homogeneous kaolin fibers having an alumina and silica content in the range of about 95 to 99.5 percent by weight and an average fiber diameter in the range of about 1 to 5 microns, said filter unit being effective in the filtration of substantial amounts of said alkaloid and volatile materials from the tobacco smoke passing therethrough and effectively reducing the temperature of said tobacco smoke, and said filter unit being effective in substantially smaller amounts than those of conventional filter materials.

2. The article of claim 1 wherein the kaolin fibers have an average diameter of about 2.8 microns.

3. The article of claim 1 wherein the kaolin fibers have an average density less than 8 pounds per cubic foot.

4. The article of claim 3 wherein the kaolin fibers have an average density in the range of about 2.5 pounds to 4.5 pounds per cubic foot.

5. The article of claim 1 wherein the kaolin fiber filter is used in combination with an other smoke filter unit thereby providing a multicomponent filter, and said kaolin fiber filter is disposed between said other filter unit and said burnable tobacco charge.

6. The article of claim 1 wherein the smoking article is a cigarette and the kaolin fiber filter comprises a pre-filter unit positioned immediately adjacent to the burnable tobacco charge.

7. The article of claim 1, in which said filter unit is formed from a blanket, strip, cylinder, rope, braid or other form of physically intermeshed fibers having an average length of about 3 to 4 inches.

8. A filter unit for tobacco smoke comprising non-toxic, synthetic, inorganic, water-insoluble, anhydrous kaolin fibers having an alumina and silica content in the range of about 95 to 99.5 percent by weight and being of a length to enable physical intermeshing of the fibers, the fibers being exposed for contact with particulates in tobacco smoke.

9. The filter unit according to claim 8 in which the fibers have an average fiber diameter in the range of 1 to 5 microns.

10. A filter unit for tobacco smoke comprising non-toxic, synthetic, inorganic, water-insoluble, anhydrous kaolin fibers having a combined alumina and silica content in the range of 95 to 99.5% by weight, said kaolin fibers being formed to said filter unit length from substantially homogeneous kaolin fiber material in which said kaolin fibers have an average fiber diameter of about 1 to 5 microns and an average length of about 3 to 4 inches whereby such fibers are intermeshed with each other and physically held together, and said kaolin fibers being disposed in said filter unit for direct contact with particulates in tobacco smoke.

11. The filter unit according to claim 10, which includes means for preventing fragmentation of said kaolin fibers during use.

12. The filter unit according to claim 11, in which said means comprises another smoke filter unit disposed adjacent to and downstream of said kaolin fibers.

* * * * *